US006880183B2

(12) United States Patent
Song

(10) Patent No.: US 6,880,183 B2
(45) Date of Patent: Apr. 19, 2005

(54) PORTABLE HIP-BATHING DEVICE

(76) Inventor: Il Ho Song, 41-204 Kangdong Apt., Amsa-dong, Kangdong-ku 134-050, Seoul (KR)

( * ) Notice: Subject to any disclaimer, the term of this patent is extended or adjusted under 35 U.S.C. 154(b) by 0 days.

(21) Appl. No.: 10/450,221

(22) PCT Filed: Nov. 6, 2001

(86) PCT No.: PCT/KR01/01882

§ 371 (c)(1),
(2), (4) Date: Jun. 11, 2003

(87) PCT Pub. No.: WO02/083055

PCT Pub. Date: Oct. 24, 2002

(65) Prior Publication Data

US 2004/0025246 A1 Feb. 12, 2004

(30) Foreign Application Priority Data

Apr. 14, 2001 (KR) ..... 2001-10534

(51) Int. Cl.[7] ..... A47K 1/04
(52) U.S. Cl. ..... 4/619; 4/651
(58) Field of Search ..... 4/455, 588, 619, 4/651

(56) References Cited

U.S. PATENT DOCUMENTS 290,598 A * 12/1883 Niedringhaus ..... 220/890
1,811,896 A * 6/1931 Ross ..... 4/619
2,112,409 A * 3/1938 Prince ..... 4/588

FOREIGN PATENT DOCUMENTS

JP 09-192197 A 7/1997
JP 10-337318 A 12/1998
JP 2000-139760 A 5/2000

OTHER PUBLICATIONS

Abstract of Japan 10–337318 A Filed Dec. 1998.
Abstract of Japan 2000–139760 A Filed May 2000.
Abstract of Japan 09/192197 A Filed Jul. 1997.

* cited by examiner

*Primary Examiner*—Charles E. Phillips
(74) *Attorney, Agent, or Firm*—Ladas & Parry LLP

(57) ABSTRACT

A portable hip-bathing device is made of a vinyl sheet capable of being carried in a folded state, and, in use air is blown into it to form the shape of a hip-bathing device adapted to contain water. In order to prevent overflow a horizontal flat part is formed on a wall of a supporting part and a plurality of water discharge holes are provided in the flat part to prevent bathing water from rising above the flat part when carrying out hip-bathing.

4 Claims, 4 Drawing Sheets

PORTABLE HIP-BATHING DEVICE

FIELD OF THE INVENTION

The present invention relates to a portable hip-bathing device. Particularly, the present invention relates to a portable hip-bathing device in which the device is made of a vinyl sheet so as to make it possible to carry it in a folded state, and, in order to use it, air is blown into it to inflate it into a shape of a hip-bathing device and to contain water for hip-bathing while preventing any water overflow.

BACKGROUND OF THE INVENTION

Generally, the anal diseases such as anal fistula, denture and hemorrhoids are treated by surgery and drugs, as well as performing hip-bathing.

The hip-bathing is carried out with hot water contained in a clean tub, and by dipping the hip within the hot water. At home, the hip-bathing is carried out in a bathtub or in a hip-bathing device.

However, when the patient goes out or goes on a trip, the hip-bathing device cannot be carried with the patient, and therefore, at these times, the patient cannot do the hip-bathing. Consequently, the treatment becomes difficult, and therefore, there has arisen a demand for a conventional portable hip-bathing device.

FIGS. 1 and 2 illustrate the conventional portable hip-bathing device. It is made of rubber or a synthetic resin, and if air is blown through an air injection hole 130 into the device, the device is swelled, forming at the same time a supporting part 110 and a water containing part 120.

That is, as shown in FIG. 2, a hollow is formed in the interior of the supporting part 110, and retains its shape owing to the blown-in air. Further, the water containing part 120 is formed so that hot water can be contained within it.

If the blown-in air is discharged out of the supporting part 110, the whole device can be folded up into a compact size. Meanwhile, if it is to be used, air is blown into it to restore its shape.

If a water containing space part 140 is formed owing to the supporting part 110 and the water containing part 120, then hot water is put into the water containing space part 140, so that a hip-bathing can be carried out.

In this conventional hip-bathing device, however, if the hip is dipped into the hot water, then the water overflows over the supporting part 110, with the result that clothing may become wet, thereby bringing a significant inconvenience.

SUMMARY OF THE INVENTION

The present invention is intended to overcome the above described disadvantages of the conventional technique.

Therefore it is an object of the present invention to provide a portable hip-bathing device in which drain holes are provided to prevent any overflow of the bathing water over the supporting part.

In achieving the above object, the portable hip-bathing device capable of being folded to carry it, and capable of receiving air to form a water containing part according to the present invention includes: a horizontal flat part formed on a wall of a supporting part; and a plurality of water discharge holes formed in the flat part to prevent bathing water from coming up above a certain height when carrying out hot bathing.

Meanwhile, the water containing part has a horizontal flat part at a certain height, and a plurality of discharge holes are formed in the flat part, the holes communicating with the outside, so that the water level can be maintained at the level of the flat part.

BRIEF DESCRIPTION OF THE DRAWINGS

The above object and other advantages of the present invention will become more apparent by describing in detail the preferred embodiment of the present invention with reference to the attached drawings in which.

| <Names of elements> |
|---|
| 200: bathing device |
| 210: supporting part |
| 220: water containing part |
| 230: air-injecting hole |
| 240: water containing space part |
| 250: discharge hole |
| 260: flat part |

DETAILED DESCRIPTION OF THE PREFERRED EMBODIMENT

Now the present invention will be described in detail referring to FIGS. 3 and 4.

Figure 1:
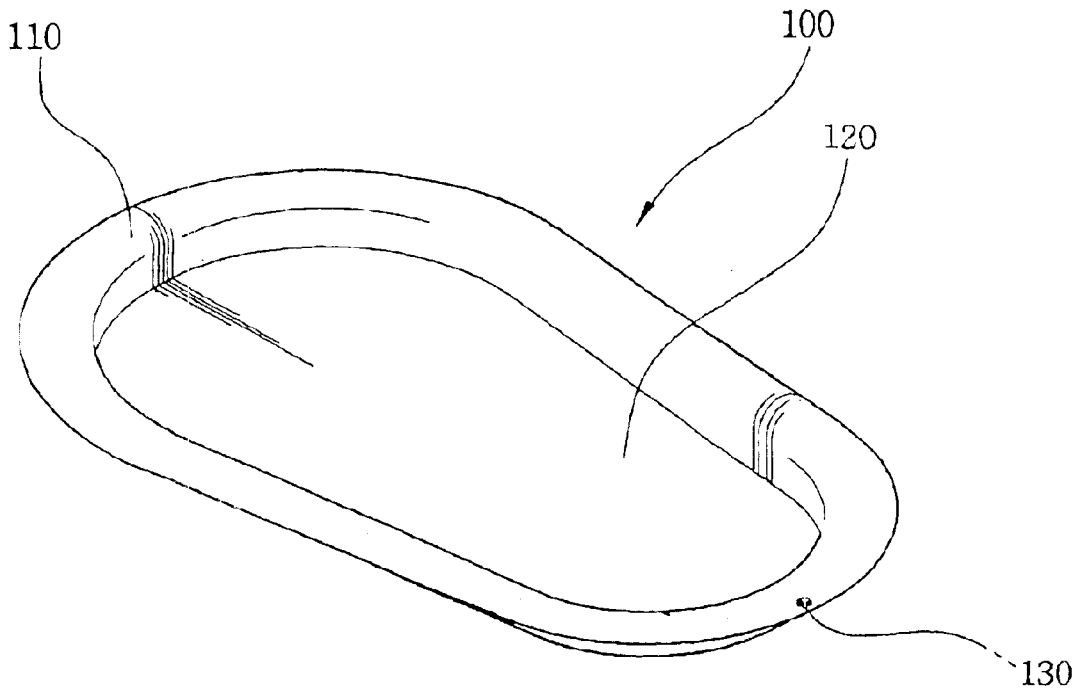
FIG. 1 (PRIOR ART)
FIG. 1 is a perspective view of the conventional portable hip-bathing device.
Figure 2:
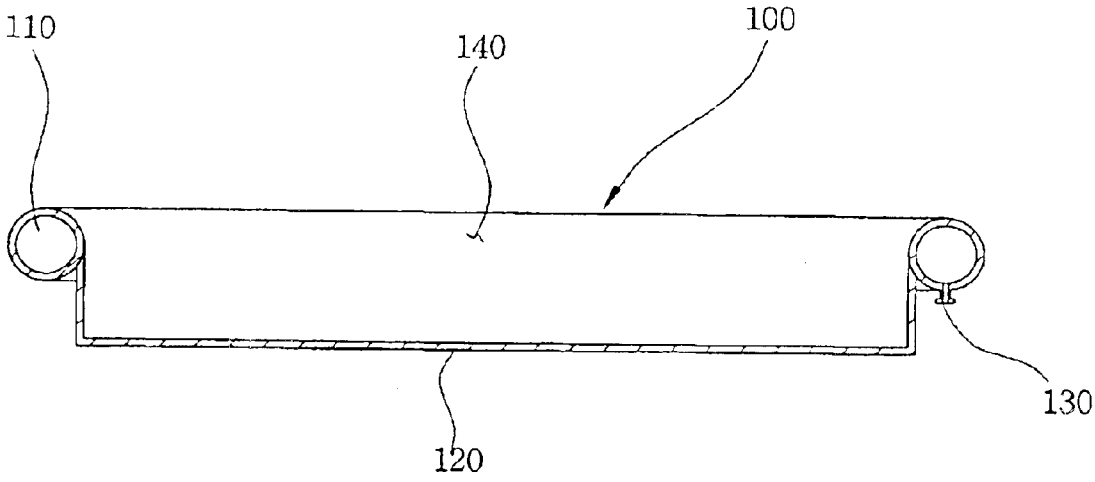
FIG. 2 (PRIOR ART)
FIG. 2 is a sectional view of the device of FIG. 1.
Figure 3:
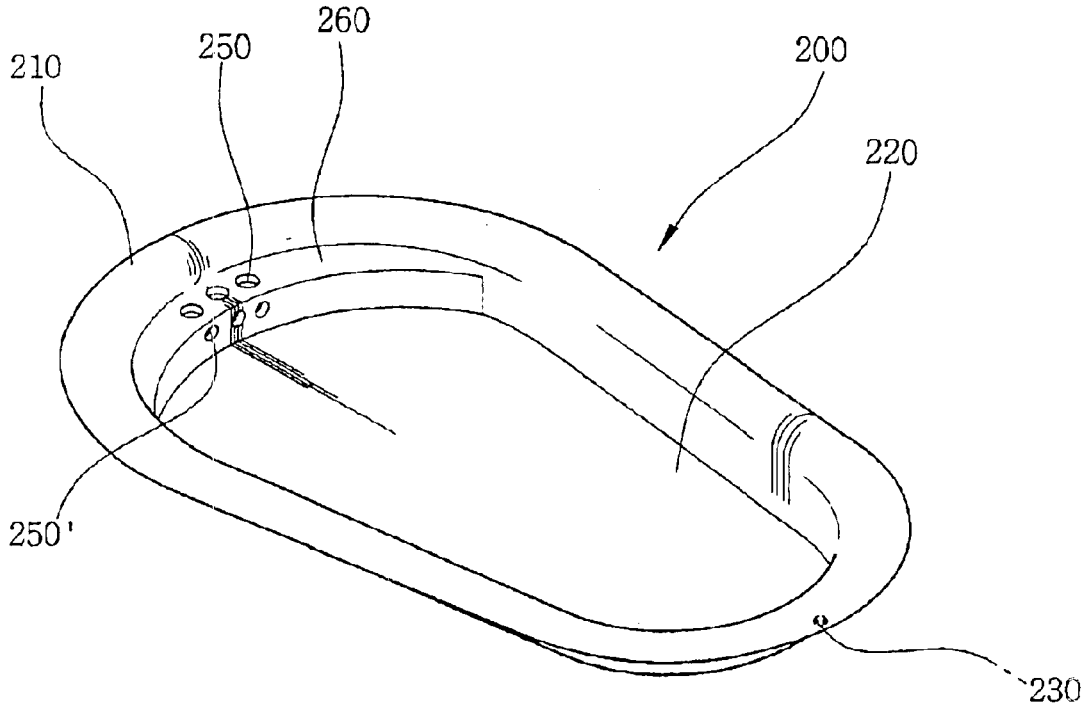
FIG. 3 is a perspective view of the portable hip-bathing device according to the present invention.
Figure 4:
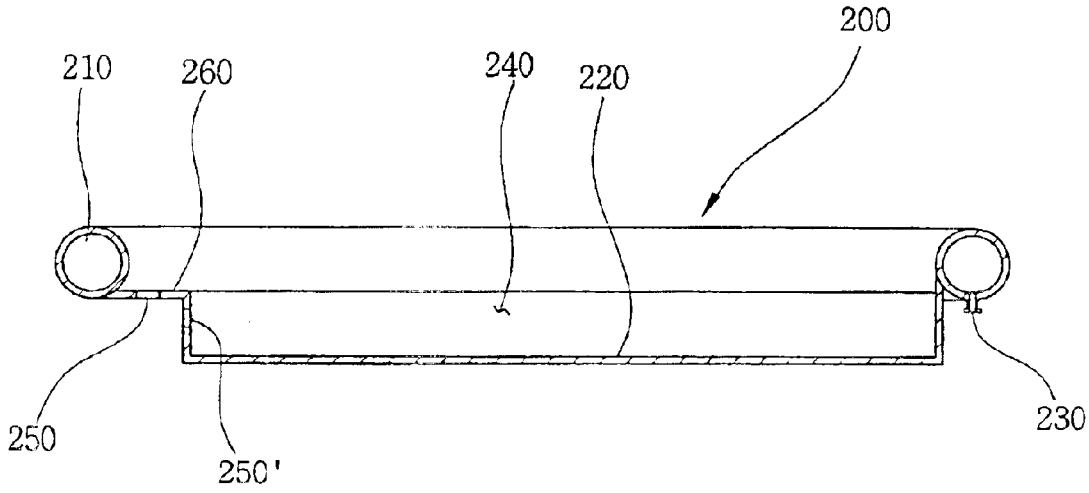
FIG. 4 is a sectional view of the device of FIG. 3.

FIG. 3 is a perspective view of the portable hip-bathing device according to the present invention. FIG. 4 is a sectional view of the device of FIG. 3.

If air is injected through an air injecting hole 230 into the hollow of a supporting part 210, then the hip-bathing device is swelled into the shape of a bathing device 200.

Under this condition, the hip-bathing device 200 is provided with a horizontal flat part 260 at a certain height of a water containing part 220. Further, a plurality of discharge holes 250 are formed in the flat part 260, for discharging the bathing water.

The outer bottom of the flat part 260 is exposed to the outside, and therefore, the discharge holes 250 also communicate with the outside.

Accordingly, if the bathing water is contained in a water containing space part 240, the water height is maintained at the level of the flat part 260. Therefore, even if water is continuously supplied into the water containing space part 240, the bathing water does not overflow over the supporting part 210, but is discharged through the discharge holes to the outside. Accordingly, the bathing water can be maintained at the level of the flat part 260.

Thus, when undertaking hip-bathing, the bathing water does not overflow over the supporting part 210, but is discharged through the discharge holes 250 to the outside. Accordingly, the clothing of the bathing person will never get wet.

Meanwhile, in another embodiment of the present invention, the flat part 260 is eliminated, and discharge holes 250 are formed in the wall of the water containing part 220 at a certain height thereof.

In this case, however, the bathing water can be contained up to the lower edges of the discharge holes 250, and therefore, the level of the bathing water can become lower so much, with the result that the total amount of the bathing water is decreased. In this case the manufacture of the device is simplified.

According to the present invention as described above, a flat part is provided on the supporting part, and discharge holes are formed on the flat part to prevent any overflow of the bathing water. Thus the bathing water can be prevented from overflowing over the supporting part, and therefore, the clothing of the bathing person is not wet. Accordingly, this hip-bathing device can be conveniently used, when the person goes on a trip.

What is claimed is:

1. A portable hip-bathing device capable of being folded to be carried and capable of receiving air to form a water containing part, comprising an inflatable supporting part on a wall of said water containing part; a horizontal flat part formed on said wall of said supporting part; and a plurality of water discharge holes formed in said flat part to prevent bathing water from coming up above the flat part when carrying out hip-bathing.

2. The hip-bathing device of claim 1, wherein said horizontal flat part extends partially around the water containing part.

3. The hip-bathing device of claim 1, wherein said inflatable supporting part is connected via said horizontal flat part to said wall of said water containing part.

4. The hip-bathing device of claim 3, wherein said flat part extends outwardly of said wall of the water containing part.

* * * * *